US010240452B2

(12) United States Patent
Robison et al.

(10) Patent No.: US 10,240,452 B2
(45) Date of Patent: Mar. 26, 2019

(54) RESERVOIR ANALYSIS WITH WELL PUMPING SYSTEM

(71) Applicant: WEATHERFORD TECHNOLOGY HOLDINGS, LLC, Houston, TX (US)

(72) Inventors: Clark E. Robison, Tomball, TX (US); John H. Hallman, Montgomery, TX (US); James S. Trapani, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 552 days.

(21) Appl. No.: 14/947,588

(22) Filed: Nov. 20, 2015

(65) Prior Publication Data

US 2017/0145811 A1 May 25, 2017

(51) Int. Cl.

| | |
|---|---|
| ***E21B 43/12*** | (2006.01) |
| ***E21B 47/00*** | (2012.01) |
| ***E21B 47/18*** | (2012.01) |

(52) U.S. Cl.

CPC ..... *E21B 47/0007* (2013.01); *E21B 43/126* (2013.01); *E21B 47/18* (2013.01)

(58) Field of Classification Search

CPC .... E21B 47/18; E21B 47/0007; E21B 43/126; E21B 47/0008; E21B 47/122; E21B 47/12; E21B 47/14

See application file for complete search history.

(56) References Cited

U.S. PATENT DOCUMENTS

| | | | | |
|---|---|---|---|---|
| 5,963,508 | A * | 10/1999 | Withers | G01V 1/008 166/250.1 |
| 6,757,218 | B2 * | 6/2004 | Dubinsky | E21B 47/18 175/50 |
| 7,669,651 | B1 * | 3/2010 | Carstensen | E21B 47/0008 166/105 |
| 2002/0007952 | A1 * | 1/2002 | Vann | E21B 43/126 166/369 |
| 2010/0111716 | A1 * | 5/2010 | Gibbs | F04B 49/065 417/63 |
| 2011/0155378 | A1 * | 6/2011 | Cabanilla | C09K 8/58 166/309 |

(Continued)

OTHER PUBLICATIONS

Weatherford; "Rotaflex Long Stroke Pumping Units", Company Article 10949.00, dated 2014, 22 pages.

(Continued)

*Primary Examiner* — Daniel P Stephenson
(74) *Attorney, Agent, or Firm* — Smith IP Services, P.C.

(57) ABSTRACT

A reservoir analysis method can include transmitting a signal from a downhole pump in a wellbore, receiving the signal at another wellbore, and determining a reservoir characteristic from the received signal. A reservoir analysis system can include a downhole pump positioned in a wellbore and a sensor positioned at another wellbore. The downhole pump selectively transmits a signal, and the sensor receives the signal. Another reservoir analysis method can include selectively changing a reciprocating displacement of a rod string connected to a downhole pump in a wellbore, transmitting a signal from the downhole pump in response to the changed reciprocating displacement, receiving the signal at another wellbore, and determining a reservoir characteristic from the received signal.

23 Claims, 3 Drawing Sheets

(56) References Cited

U.S. PATENT DOCUMENTS

| | | | | |
|---|---|---|---|---|
| 2011/0247831 | A1* | 10/2011 | Smith | E21B 43/129 166/372 |
| 2014/0158380 | A1* | 6/2014 | Varkey | E21B 33/08 166/286 |
| 2017/0016312 | A1* | 1/2017 | Clarke | E21B 43/128 |
| 2017/0145811 | A1* | 5/2017 | Robison | E21B 47/0007 |
| 2017/0234124 | A1* | 8/2017 | Dang | E21B 47/18 175/45 |
| 2017/0332156 | A1* | 11/2017 | White | H04Q 9/04 |
| 2017/0362934 | A1* | 12/2017 | Switzer | E21B 47/18 |

OTHER PUBLICATIONS

Weatherford; "Rotaflex Long Stroke Pumping Unit", Reciprocating Rod Lift, Company Article 843.02, dated 2007, 4 pages.

Specification and Drawing for International Patent Application No. PCT/US15/43694 filed Aug. 5, 2015, 54 pages.

* cited by examiner

RESERVOIR ANALYSIS WITH WELL PUMPING SYSTEM

BACKGROUND

This disclosure relates generally to equipment utilized and operations performed in conjunction with a subterranean well and, in one example described below, more particularly provides a well pumping system and associated method.

Reservoir fluids can sometimes flow to the earth's surface when a well has been completed. However, with some wells, reservoir pressure may be insufficient (at the time of well completion or thereafter) to lift the fluids (in particular, liquids) to the surface. In those circumstances, technology known as "artificial lift" can be employed to bring the fluids to or near the surface (such as a subsea production facility or pipeline, a floating rig, etc.).

Various types of artificial lift technology are known to those skilled in the art. In one type of artificial lift, a downhole pump is operated by reciprocating a string of "sucker" rods deployed in a well. An apparatus (such as, a walking beam-type pump jack or a hydraulic actuator) located at the surface can be used to reciprocate the rod string.

Therefore, it will be readily appreciated that improvements are continually needed in the arts of constructing and operating artificial lift systems. Such improvements may be useful for lifting oil, water, gas condensate or other liquids from wells, may be useful with various types of wells (such as, gas production wells, oil production wells, water or steam flooded oil wells, geothermal wells, etc.), and may be useful for any other application where reciprocating motion is desired. Improvements are also continually needed in the art of reservoir analysis.

DETAILED DESCRIPTION

Figure 1:
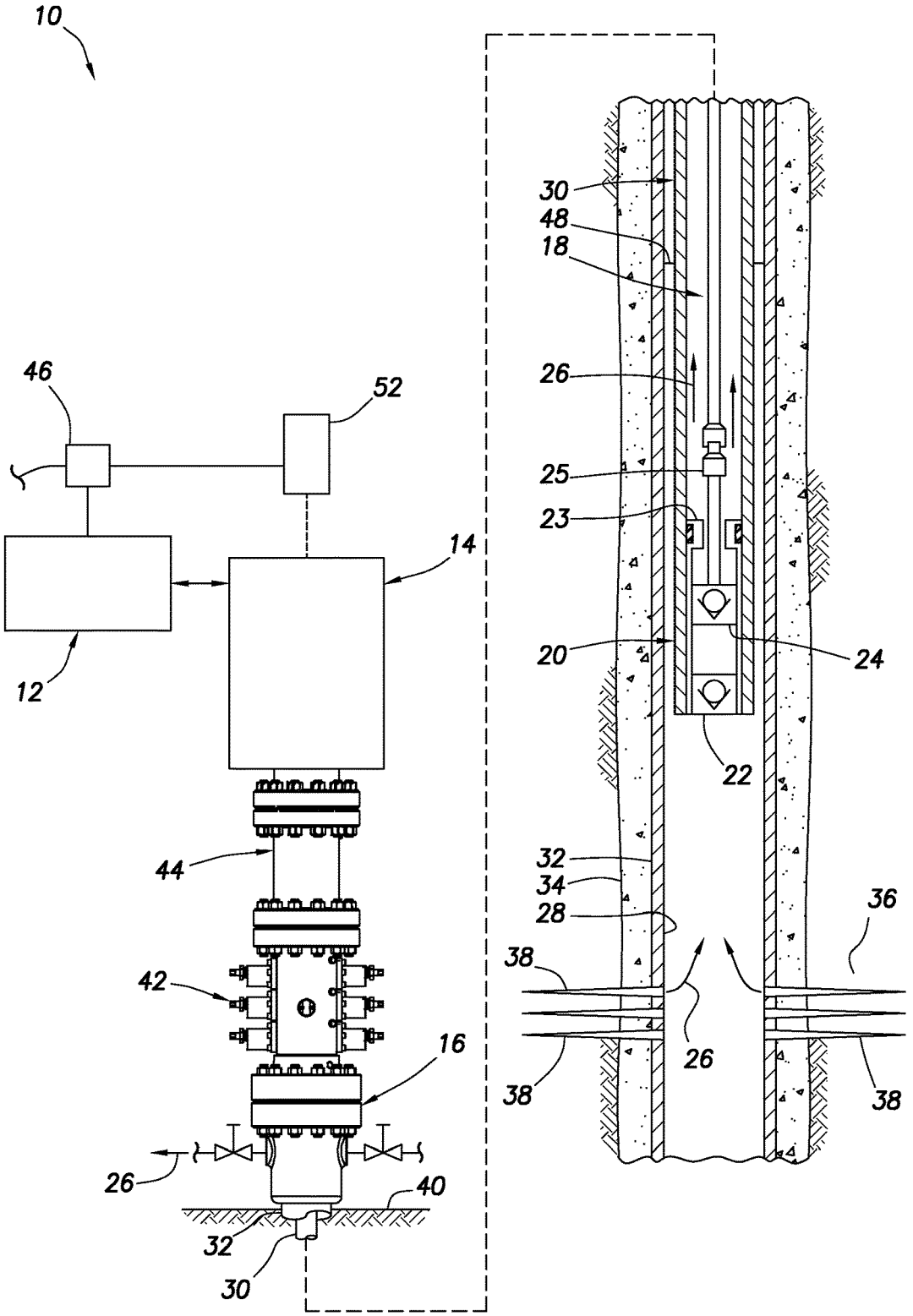
FIG. 1 is a representative partially cross-sectional view of an example of a well pumping system and associated method which can embody principles of this disclosure.

Representatively illustrated in FIG. 1 is a well pumping system 10 and associated method for use with a subterranean well, which system and method can embody principles of this disclosure. However, it should be clearly understood that the well pumping system 10 and method are merely one example of an application of the principles of this disclosure in practice, and a wide variety of other examples are possible. Therefore, the scope of this disclosure is not limited at all to the details of the system 10 and method as described herein or depicted in the drawings.

In the FIG. 1 example, a power source 12 is used to supply energy to an actuator 14 mounted on a wellhead 16. In response, the actuator 14 reciprocates a rod string 18 extending into the well, thereby operating a downhole pump 20.

The rod string 18 may be made up of individual sucker rods connected to each other, although other types of rods or tubes may be used, the rod string 18 may be continuous or segmented, a material of the rod string 18 may comprise steel, composites or other materials, and elements other than rods may be included in the string. Thus, the scope of this disclosure is not limited to use of any particular type of rod string, or to use of a rod string at all. It is only necessary for purposes of this disclosure to communicate reciprocating motion of the actuator 14 to the downhole pump 20, and it is therefore within the scope of this disclosure to use any structure capable of such transmission.

The downhole pump 20 is depicted in FIG. 1 as being of the type having a stationary or "standing" valve 22 and a reciprocating or "traveling" valve 24. The traveling valve 24 is connected to, and reciprocates with, the rod string 18, so that fluid 26 is pumped from a wellbore 28 into a production tubing string 30. However, it should be clearly understood that the downhole pump 20 is merely one example of a wide variety of different types of pumps that may be used with the well pumping system 10 and method of FIG. 1, and so the scope of this disclosure is not limited to any of the details of the downhole pump described herein or depicted in the drawings.

The wellbore 28 is depicted in FIG. 1 as being generally vertical, and as being lined with casing 32 and cement 34. In other examples, a section of the wellbore 28 in which the pump 20 is disposed may be generally horizontal or otherwise inclined at any angle relative to vertical, and the wellbore section may not be cased or may not be cemented. Thus, the scope of this disclosure is not limited to use of the well pumping system 10 and method with any particular wellbore configuration.

In the FIG. 1 example, the fluid 26 originates from an earth formation 36 penetrated by the wellbore 28. The fluid 26 flows into the wellbore 28 via perforations 38 extending through the casing 32 and cement 34. The fluid 26 can be a liquid, such as oil, gas condensate, water, etc. However, the scope of this disclosure is not limited to use of the well pumping system 10 and method with any particular type of fluid, or to any particular origin of the fluid.

As depicted in FIG. 1, the casing 32 and the production tubing string 30 extend upward to the wellhead 16 at or near the earth's surface 40 (such as, at a land-based wellsite, a subsea production facility, a floating rig, etc.). The production tubing string 30 can be hung off in the wellhead 16, for example, using a tubing hanger (not shown). Although only a single string of the casing 32 is illustrated in FIG. 1 for clarity, in practice multiple casing strings and optionally one or more liner strings (a liner string being a pipe that extends from a selected depth in the wellbore 28 to a shallower depth, typically sealingly "hung off" inside another pipe or casing) may be installed in the well.

In the FIG. 1 example, a rod blowout preventer stack 42 and a stuffing box 44 are connected between the actuator 14 and the wellhead 16. The rod blowout preventer stack 42 includes various types of blowout preventers (BOP's) configured for use with the rod string 18. For example, one blowout preventer can prevent flow through the blowout preventer stack 42 when the rod string 18 is not present therein, and another blowout preventer can prevent flow through the blowout preventer stack 42 when the rod string 18 is present therein. However, the scope of this disclosure is not limited to use of any particular type or configuration of blowout preventer stack with the well pumping system 10 and method of FIG. 1.

The stuffing box 44 includes an annular seal (not visible in FIG. 1) about an upper end of the rod string 18. In some examples, a rod of the type known to those skilled in the art as a "polished rod" suitable for sliding and sealing engagement within the annular seal in the stuffing box 44 may be connected at an upper end of the rod string 18. The polished rod may be a component of the actuator 14, such as, a rod extending downwardly from a piston of the actuator (see FIG. 2).

The power source 12 may be connected directly to the actuator 14, or it may be positioned remotely from the actuator 14 and connected with, for example, suitable electrical cables, mechanical linkages, hydraulic hoses or pipes. Operation of the power source 12 is controlled by a control system 46.

The control system 46 may allow for manual or automatic operation of the actuator 14 via the power source 12, based on operator inputs and measurements taken by various sensors. The control system 46 may be separate from, or incorporated into, the actuator 14 or the power source 12. In one example, at least part of the control system 46 could be remotely located or web-based, with two-way communication between the actuator 14, the power source 12 and the control system 46 being via, for example, satellite, wireless or wired transmission.

The control system 46 can include various components, such as a programmable controller, input devices (e.g., a keyboard, a touchpad, a data port, etc.), output devices (e.g., a monitor, a printer, a recorder, a data port, indicator lights, alert or alarm devices, etc.), a processor, software (e.g., an automation program, customized programs or routines, etc.) or any other components suitable for use in controlling operation of the actuator 14 and the power source 12. The scope of this disclosure is not limited to any particular type or configuration of a control system.

In operation of the well pumping system 10 of FIG. 1, the control system 46 causes the power source 12 to increase energy input to the actuator 14, in order to raise the rod string 18. Conversely, the energy input to the actuator 14 is reduced or removed, in order to allow the rod string 18 to descend. Thus, by alternately increasing and decreasing energy input to the actuator 14, the rod string 18 is reciprocated, the downhole pump 20 is actuated and the fluid 26 is pumped out of the well.

It can be advantageous to control a reciprocation speed of the rod string 18, instead of reciprocating the rod string as fast as possible. For example, a fluid interface 48 in the wellbore 28 can be affected by the flow rate of the fluid 26 from the well. The fluid interface 48 could be an interface between oil and water, gas and water, gas and gas condensate, gas and oil, steam and water, or any other fluids or combination of fluids.

If the flow rate is too great, the fluid interface 48 may descend in the wellbore 28, so that eventually the pump 20 will no longer be able to pump the fluid 26 (a condition known to those skilled in the art as "pump-off"). On the other hand, it is typically desirable for the flow rate of the fluid 26 to be at a maximum level that does not result in pump-off. In addition, a desired flow rate of the fluid 26 may change over time (for example, due to depletion of a reservoir, changed offset well conditions, water or steam flooding characteristics, etc.).

A "gas-locked" downhole pump 20 can result from a pump-off condition, whereby gas is received into the downhole pump 20. The gas is alternately expanded and compressed in the downhole pump 20 as the traveling valve 24 reciprocates, but the fluid 26 cannot flow into the downhole pump 20, due to the gas therein.

In the FIG. 1 well pumping system 10 and method, the control system 46 can automatically control operation of the actuator 14 via the power source 12 to regulate the reciprocation speed, so that pump-off is avoided, while achieving any of various desirable objectives. Those objectives may include maximum flow rate of the fluid 26, optimized rate of electrical power consumption, reduction of peak electrical loading, etc. However, it should be clearly understood that the scope of this disclosure is not limited to pursuing or achieving any particular objective or combination of objectives via automatic reciprocation speed regulation by the control system 46.

As mentioned above, the power source 12 is used to variably supply energy to the actuator 14, so that the rod string 18 is displaced alternately to its upper and lower stroke extents. These extents do not necessarily correspond to maximum possible upper and lower displacement limits of the rod string 18 or the pump 20.

For example, it is typically undesirable for a valve rod bushing 25 above the traveling valve 24 to impact a valve rod guide 23 above the standing valve 22 when the rod string 18 displaces downward (a condition known to those skilled in the art as "pump-pound"). Thus, it is preferred that the rod string 18 be displaced downward only until the valve rod bushing 25 is near its maximum possible lower displacement limit, so that it does not impact the valve rod guide 23.

On the other hand, the longer the stroke distance (without impact), the greater the productivity and efficiency of the pumping operation (within practical limits), and the greater the compression of fluid between the standing and traveling valves 22, 24 (e.g., to avoid gas-lock). In addition, a desired stroke of the rod string 18 may change over time (for example, due to gradual lengthening of the rod string 18 as a result of lowering of a liquid level (such as at fluid interface 48) in the well, etc.).

In the FIG. 1 well pumping system 10 and method, the control system 46 can automatically control operation of the power source 12 to regulate the upper and lower stroke extents of the rod string 18, so that pump-pound is avoided, while achieving any of various desirable objectives. Those objectives may include maximizing rod string 18 stroke length, maximizing production, minimizing electrical power consumption rate, minimizing peak electrical loading, etc. However, it should be clearly understood that the scope of this disclosure is not limited to pursuing or achieving any particular objective or combination of objectives via automatic stroke extent regulation by the control system 46.

In the FIG. 1 example, the system 10 includes a continuous position sensor 52 in communication with the control system 46. The continuous position sensor 52 is capable of continuously detecting a position of a reciprocating member at or near the surface 40 (such as, the piston or piston rod of the actuator 14 (see FIG. 2), the rod 50 or another member).

An output of the continuous position sensor 52 can be useful to achieve a variety of objectives, such as, controlling stroke distance, speed and extents to maximize production and efficiency, minimize electrical power consumption and/or peak electrical loading, maximize useful life of the rod string 18, etc. However, the scope of this disclosure is not limited to pursuing or achieving any particular objective or combination of objectives via use of a continuous position sensor.

As used herein, the term "continuous" is used to refer to a substantially uninterrupted sensing of position by the sensor 52. For example, when used to continuously detect a position of a piston of the actuator 14 (see FIG. 2), the sensor 52 can detect the piston's position during all portions of its reciprocating motion, and not just at certain discrete points (such as, at the upper and lower stroke extents). However, a continuous position sensor may have a particular resolution (e.g., 0.001-0.1 mm) at which it can detect the position of a member. Accordingly, the term "continuous" does not require an infinitely small resolution.

Using the continuous position sensor 52, the control system 46 can be provided with an accurate measurement of a reciprocating member position at any point in the member's reciprocation, thereby dispensing with any need to perform calculations based on discrete detections of position. It will be appreciated by those skilled in the art that actual continuous position detection can be more precise than such calculations of position, since various factors (including known and unknown factors, such as, temperature, fluid compressibility, fluid leakage, etc.) can affect the calculations.

By continuously sensing the position of a reciprocating member at or near a top of the rod string 18, characteristics of the rod string's reciprocating displacement are communicated to the control system 46 at each point in the rod string's reciprocating displacement. The control system 46 can, thus, determine whether the rod string's 18 position, speed and acceleration correspond to desired preselected values.

If there is a discrepancy between the desired preselected values and the rod string's reciprocating displacement as detected by the sensor 52, the control system 46 can change how energy is supplied to the actuator 14 by the power source 12, so that the reciprocating displacement will conform to the desired preselected values. For example, the control system 46 may change a level, timing, frequency, duration, etc., of the energy input to the actuator 14, in order to change the rod string's upper or lower stroke extent, or velocity or acceleration at any point in the rod string's reciprocating displacement.

Note that the desired preselected values may change over time. As mentioned above, it may be desirable to change the upper or lower stroke extent, or the pumping rate, during the pumping operation, for example, due to the level of the fluid interface 48 changing, reservoir depletion over time, detection of a pump-off, pump-pound or gas-lock condition, etc.

Although the continuous position sensor 52 provides certain benefits in the system 10 and method example of FIG. 1, it should be clearly understood that it is not necessary in keeping with the scope of this disclosure for a continuous position sensor or any other particular type of sensor to be used.

Figure 2:
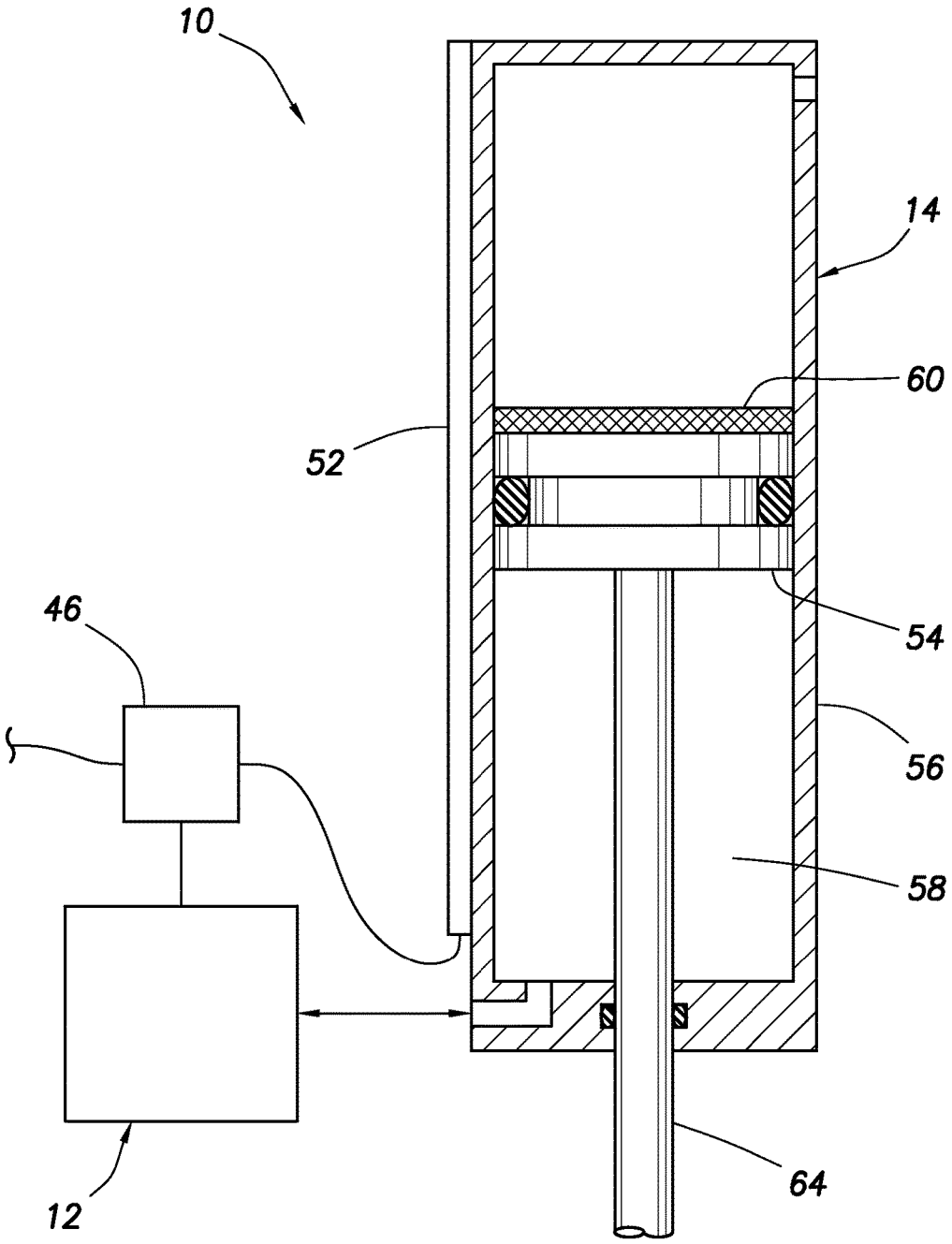
FIG. 2 is a representative partially cross-sectional view of an actuator that may be used with the system and method of FIG. 1.

Referring additionally now to FIG. 2, an example of the actuator 14 that may be used with the system 10 and method is representatively illustrated. The actuator 14 in this example is a single-acting hydraulic actuator, but other types of actuators may be used (such as, mechanical, electrical, double-acting hydraulic, accumulator-balanced hydraulic, etc.). Thus, the scope of this disclosure is not limited to use of any particular type of actuator.

In the FIG. 2 example, the actuator 14 includes a piston 54 sealingly and reciprocably disposed in a generally cylindrical housing 56. A piston rod 64 is connected to the piston 54 and extends downwardly through a lower end of the housing 56. The piston rod 64 is connected to the rod string 18 (such as, below the annular seal in the stuffing box 44).

The power source 12 in this example comprises a hydraulic pressure source (such as, a hydraulic pump and associated equipment) for supplying energy in the form of fluid pressure to a chamber 58 in the housing 56 below the piston 54. To raise the piston 54, the piston rod 64 and the rod string 18, hydraulic fluid at increased pressure is supplied to the chamber 58 from the power source 12. To cause the piston 54, piston rod 64 and rod string 18 to descend, the pressure in the chamber 58 is reduced (with hydraulic fluid being returned from the chamber to the power source 12).

In this example, the sensor 52 is attached externally to the housing 56. In other examples, the sensor 52 could be positioned internal to (or in a wall of) the housing 56, or the sensor 52 could be associated with the stuffing box 44 to continuously detect a position of the piston rod 64 as it reciprocates. Thus, the scope of this disclosure is not limited to any particular position or orientation of the sensor 52.

A magnet 60 is attached to, and displaces with, the piston 54. A position of the magnet 60 (and, thus, of the piston 54) is continuously sensed by the sensor 52 during reciprocating displacement of the piston. A suitable magnet for use in the actuator 14 is a neodymium magnet (such as, a neodymium-iron-boron magnet) in ring form. However, other types and shapes of magnets may be used in keeping with the principles of this disclosure.

In other examples, the magnet 60 could be attached to, and displace with the piston rod 64 or another reciprocating component of the actuator 14. The scope of this disclosure is not limited to any particular position of the magnet 60, or detection of the position of any particular component of the actuator 14.

A suitable linear position sensor (or linear variable displacement transducer) for use as the sensor 52 in the system 10 is available from Rota Engineering Ltd. of Manchester, United Kingdom. Other suitable position sensors are available from Hans Turck GmbH & Co. KG of Germany, and from Balluff GmbH of Germany. However, the scope of this disclosure is not limited to use of any particular sensor with the system 10.

Figure 3:
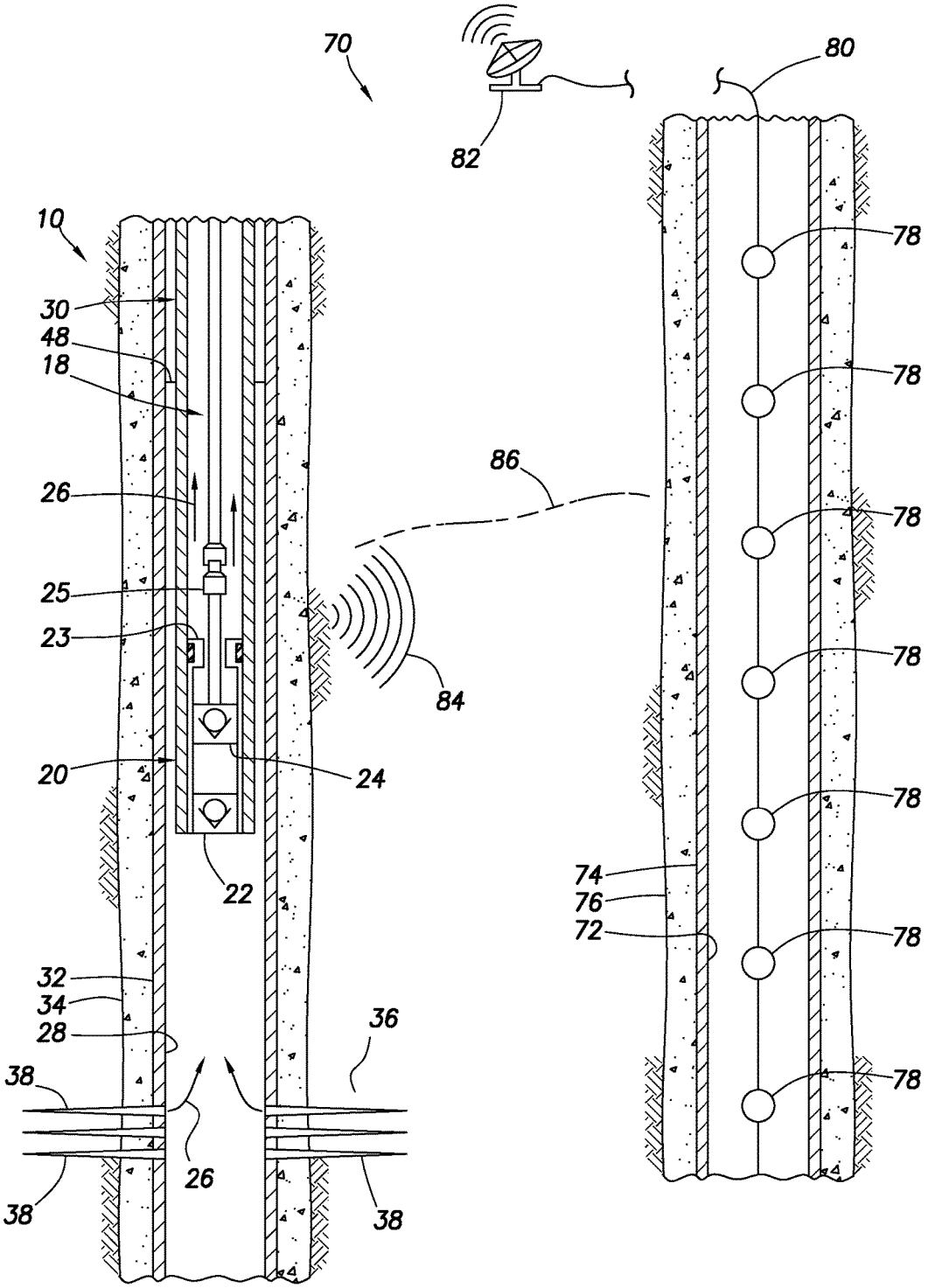
FIG. 3 is a representative cross-sectional view of a reservoir analysis system and associated method that may be practiced with the well pumping system and method of FIG. 1.

Referring additionally now to FIG. 3, an example of a reservoir analysis system 70 and associated method are representatively illustrated. In the FIG. 3 example, elements of the well pumping system 10 and associated method of FIGS. 1 & 2 are utilized, but it should be clearly understood that other well pumping systems and methods may be used with the reservoir analysis system 70 and method, in keeping with the principles of this disclosure.

In the reservoir analysis system 70 and method of FIG. 3, another wellbore 72 is located in a vicinity of the wellbore 28, so that the wellbore 72 also penetrates the earth formation 36. For example, the wellbores 28, 72 could be drilled from a same well pad, and may be used to produce from, and/or inject into, the same formation 36. Both wellbores 28, 72 could be used for producing fluids 26, both wellbores could be used for injection (such as, for water flooding, steam flooding, gas disposal, conformance treatments, etc.), or one wellbore could be used for production and the other wellbore could be used for injection.

The formation 36 comprises a reservoir for the fluid 26, which is produced from the wellbore 28 as described above. In other examples, the formation 36 could comprise another type of reservoir (such as, for a geothermal well or a disposal well, etc.).

In other examples, the wellbore 72 may not penetrate the same earth formation 36 as the wellbore 28. The wellbores 28, 72 could be drilled to different depths, or in different directions. Although both wellbores 28, 72 are depicted in FIG. 3 as being vertical, it is not necessary for either of the wellbores to be vertical, or for the wellbores to extend in the same direction.

Similar to the wellbore 28, the wellbore 72 is illustrated in FIG. 3 as being lined with casing 74 and cement 76. However, it is not necessary for the wellbore 72 to be cased or cemented, and the scope of this disclosure is not limited to any particular configuration or construction details of the wellbore 72.

As depicted in FIG. 3, sensors 78 are positioned in the wellbore 72. The sensors 78 are distributed along a line 80 extending from the surface into the wellbore 72. For example, a wireline, slickline or optical cable may be used for the line 80, in order to convey the sensors 78 into the wellbore 72 and appropriately position the sensors therein.

Instead of separate sensors 78, the line 80 itself may serve as a distributed sensor. For example, the line 80 could include an optical fiber or other optical waveguide, and techniques known to those skilled in the art as "distributed vibration sensing" and/or "distributed acoustic sensing" may be used. Thus, the scope of this disclosure is not limited to any particular number, type or configuration of sensor(s).

In the FIG. 3 example, the sensors 78 are positioned within the casing 74. In other examples, the sensors 78 could be positioned in a wall of the casing 74 or external to the casing (such as, in the cement 76). Thus, the scope of this disclosure is not limited to any particular position of sensor(s) with respect to a wellbore, casing or cement.

The sensors 78 may communicate measurements taken in real time (e.g., as an operation progresses), or the sensors may record measurements for later download. In either case, the measurements may be received onsite, and/or the measurements may be transmitted to a remote location, such as, via a satellite communications transmitter 82 or other communications equipment.

As depicted in FIG. 3, a signal 84 is produced from the downhole pump 20, and is received by the sensors 78. Between the downhole pump 20 and the sensors 78, the signal 84 traverses the formation 36 and, therefore, acquires characteristics indicative of properties of the formation and any reservoir associated with the formation (such as, formation composition, layers, density, porosity, permeability, fault or fracture structure and location, fluid in place, fluid interface location, etc.). Those familiar with the arts of acoustic tomography, seismography and reservoir analysis can derive these or other reservoir characteristics from the signal 84 as received at the sensors 78 (see, for example, X. Wang, *Reservoir Acoustics And Its Applications,* 131 J. Acoust. Soc. Am. 3490 (2012)).

In the FIG. 3 example, the signal 84 is produced by operation of the well pumping system 10 in a manner that causes generation of the signal at the downhole pump 20. For example, the control system 46 can change the lower stroke extent of the rod string 18, so that the rod bushing 25 strikes the valve rod guide 23 and thereby deliberately causes a pump-pound condition. As another example, the control system 46 can change the upper stroke extent of the rod string 18, so that the traveling valve 24 (e.g., comprising a plunger), or another internal structure is raised at least partially out of the downhole pump 20, thereby creating an acoustic pulse.

As depicted in FIG. 3, the location of a fluid interface 86 can be identified by analysis of the signal 84 as received by the sensors 78. With this information, appropriate decisions can be made and actions taken, for example, to change a steam flooding, water flooding, fluid disposal, gas drive, conformance or other operation as needed.

It may now be fully appreciated that the above disclosure provides significant advancements to the arts of performing reservoir analysis, and monitoring and controlling operation of a well pumping system. In examples described above, the well pumping system 10 can be operated in a manner that transmits the signal 84 from the downhole pump 20 to the sensors 78, so that characteristics of a reservoir between the wellbores 28, 72 can be determined.

The above disclosure provides to the art a reservoir analysis method. In one example, the method can comprise: transmitting a signal 84 from a downhole pump 20 in a first wellbore 28; receiving the signal 84 at a second wellbore 72; and determining a reservoir characteristic from the received signal 84. Note that the signal 84 is not necessarily received in the second wellbore 72, since the sensors 78 may not be in the wellbore.

The signal 84 may comprise an acoustic signal.

The step of transmitting the signal 84 may include producing a pump-pound condition.

The step of transmitting the signal 84 may include changing a lower stroke extent of a rod string 18 connected to the downhole pump 20.

The step of transmitting the signal 84 may include at least partially withdrawing an internal structure (such as, the traveling valve 24, a pump barrel, etc.) from the downhole pump 20.

The step of transmitting the signal 84 may include changing an upper stroke extent of a rod string 18 connected to the downhole pump 20.

The step of receiving the signal 84 may include at least one sensor 78 detecting the signal in the second wellbore 72.

A reservoir analysis system 70 is also provided to the art by the above disclosure. In one example, the system 70 can include a downhole pump 20 positioned in a first wellbore 28. The downhole pump 20 selectively transmits a signal 84. At least one sensor 78 is positioned at a second wellbore 72. The sensor 78 receives the signal 84.

The system 10 may include a control system 46 that controls operation of an actuator 14 at the earth's surface 40. The actuator 14 reciprocably displaces a rod string 18 connected to the downhole pump 20.

The control system 46 may selectively change a lower stroke extent of the rod string 18. The signal 84 may be transmitted from the downhole pump 20 in response to the changed lower stroke extent. The changed lower stroke extent may produce a pump-pound condition.

The control system 46 may selectively change an upper stroke extent of the rod string 18. The signal may be transmitted from the downhole pump 20 in response to the changed upper stroke extent. The changed upper stroke extent may cause an inner structure to at least partially withdraw from the downhole pump 20.

Another reservoir analysis method is described above. In this example, the method comprises: selectively changing a reciprocating displacement of a rod string 18 connected to a downhole pump 20 in a first wellbore 28; transmitting a signal 84 from the downhole pump 20 in response to the changed reciprocating displacement; receiving the signal 84 at a second wellbore 72; and determining a reservoir characteristic from the received signal 84.

The step of changing the reciprocating displacement may be performed by a control system 46 that controls operation of an actuator 14 connected to the rod string 18. Changing the reciprocating displacement may comprise changing a lower and/or an upper stroke extent of the rod string 18.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "raised," "lowered," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A reservoir analysis method, comprising:

generating a signal from a downhole pump in a first wellbore;

transmitting the signal via an earth formation, wherein the signal acquires a characteristic indicative of at least one property of the earth formation during passage of the signal through the earth formation;

then receiving the signal at a second wellbore; and determining the at least one property of the earth formation from the received signal.

2. The method of claim 1, wherein the signal comprises an acoustic signal.

3. The method of claim 1, wherein the generating comprises producing a pump-pound condition.

4. The method of claim 1, wherein the generating comprises changing a lower stroke extent of a rod string connected to the downhole pump.

5. The method of claim 1, wherein the generating comprises at least partially withdrawing an internal structure from the downhole pump.

6. The method of claim 1, wherein the generating comprises changing an upper stroke extent of a rod string connected to the downhole pump.

7. The method of claim 1, wherein receiving the signal comprises at least one sensor detecting the signal in the second wellbore.

8. A reservoir analysis system, comprising:

a downhole pump positioned in a first wellbore, wherein the downhole pump selectively generates a signal; and at least one sensor positioned at a second wellbore, wherein the sensor receives the signal, wherein the signal is transmitted via an earth formation located between the first and second wellbores, and wherein the signal acquires a characteristic indicative of at least one property of the earth formation during passage of the signal through the earth formation.

9. A reservoir analysis system, comprising:

a downhole pump positioned in a first wellbore, wherein the downhole pump selectively transmits a signal; and at least one sensor positioned at a second wellbore, wherein the sensor receives the signal; and a control system that controls operation of an actuator at the earth's surface, wherein the actuator reciprocably displaces a rod string connected to the downhole pump.

10. The system of claim 9, wherein the control system selectively changes a lower stroke extent of the rod string.

11. The system of claim 10, wherein the signal is transmitted from the downhole pump in response to the changed lower stroke extent.

12. The system of claim 10, wherein the changed lower stroke extent produces a pump-pound condition.

13. The system of claim 9, wherein the control system selectively changes an upper stroke extent of the rod string.

14. The system of claim 13, wherein the signal is transmitted from the downhole pump in response to the changed upper stroke extent.

15. The system of claim 13, wherein the changed upper stroke extent causes an inner structure to at least partially withdraw from the downhole pump.

16. A reservoir analysis method, comprising:

selectively changing a reciprocating displacement of a rod string connected to a downhole pump in a first wellbore;

transmitting a signal from the downhole pump in response to the changed reciprocating displacement;

receiving the signal at a second wellbore; and determining a reservoir characteristic from the received signal.

17. The method of claim 16, wherein changing the reciprocating displacement is performed by a control system that controls operation of an actuator connected to the rod string.

18. The method of claim 16, wherein transmitting the signal comprises producing a pump-pound condition.

19. The method of claim 16, wherein changing the reciprocating displacement comprises changing a lower stroke extent of the rod string.

20. The method of claim 16, wherein transmitting the signal comprises at least partially withdrawing an internal structure from the downhole pump.

21. The method of claim 16, wherein changing the reciprocating displacement comprises changing an upper stroke extent of the rod string.

22. The method of claim 16, wherein receiving the signal comprises at least one sensor detecting the signal in the second wellbore.

23. The method of claim 16, wherein the signal comprises an acoustic signal.

* * * * *